US011226069B2

(12) United States Patent
Shubbar et al.

(10) Patent No.: US 11,226,069 B2
(45) Date of Patent: Jan. 18, 2022

(54) ANTI-STATIC PRESSURE TANK

(71) Applicants: Abdul Amir Shubbar, Aschaffenburg (DE); Mahdi Shubbar, Aschaffenburg (DE)

(72) Inventors: Abdul Amir Shubbar, Aschaffenburg (DE); Mahdi Shubbar, Aschaffenburg (DE)

( * ) Notice: Subject to any disclaimer, the term of this patent is extended or adjusted under 35 U.S.C. 154(b) by 281 days.

(21) Appl. No.: 16/474,618

(22) PCT Filed: Dec. 13, 2017

(86) PCT No.: PCT/DE2017/101069
§ 371 (c)(1),
(2) Date: Jun. 28, 2019

(87) PCT Pub. No.: WO2018/121812
PCT Pub. Date: Jul. 5, 2018

(65) Prior Publication Data

US 2019/0346083 A1 Nov. 14, 2019

(30) Foreign Application Priority Data

Dec. 29, 2016 (DE) ..... 10 2016 125 866.0

(51) Int. Cl.
*F17C 1/16* (2006.01)
*F17C 1/06* (2006.01)

(52) U.S. Cl.
CPC ..... *F17C 1/16* (2013.01); *F17C 1/06* (2013.01); *B65D 2213/02* (2013.01);
(Continued)

(58) Field of Classification Search
CPC ..... F17C 2205/0305; F17C 2205/0323; F17C 2260/042; F17C 1/06; F17C 1/16;
(Continued)

(56) References Cited

U.S. PATENT DOCUMENTS 3,625,264 A * 12/1971 Swain ..... F16K 31/20 141/198
2008/0043398 A1* 2/2008 Ulekleiv ..... B67D 7/0294 361/215

(Continued)

FOREIGN PATENT DOCUMENTS

WO WO 2011/152732 A1 12/2011

*Primary Examiner* — Don M Anderson
*Assistant Examiner* — Jennifer Castriotta
(74) *Attorney, Agent, or Firm* — DP IP Group; Franco S. De Liguori

(57) ABSTRACT

A pressure tank for storing high- and low-pressure fluids/gases includes a hollow body with at least one outlet having a surrounding contact area, a boss connected to the outlet, and a static eliminator wall disposed inside the hollow body. The boss has at least one aperture extending into the interior of the hollow body and is connected over its entire surface with a complementary contact area to the contact area of the outlet. The aperture has a diffuser disposed at a bottom end thereof. The diffuser is one of part of the boss, part of a neckring, and part of a coupling piece. The diffuser seals the aperture in an axial direction and has diffuser openings pointing primarily only in a radial direction. The static eliminator wall surrounds the diffusor and is one of part of the boss, part of the neckring, and part of the coupling piece.

20 Claims, 8 Drawing Sheets

(52) U.S. Cl.
CPC ..... *F17C 2203/0619* (2013.01); *F17C 2203/0663* (2013.01); *F17C 2205/0305* (2013.01); *F17C 2223/0123* (2013.01); *F17C 2260/042* (2013.01)

(58) Field of Classification Search
CPC ..... F17C 2203/0619; F17C 2203/0663; F17C 2223/0123; F17C 2223/0153; F17C 2205/0332
See application file for complete search history.

(56) References Cited

U.S. PATENT DOCUMENTS

2012/0085727 A1* 4/2012 Fratti ..... F17C 1/16 215/386
2014/0224811 A1* 8/2014 Shubbar ..... F17C 13/04 220/586

* cited by examiner

ANTI-STATIC PRESSURE TANK

BACKGROUND

Field

The present invention relates to a pressure tank for storage of high and low pressure fluids/gases, particularly LPG or LNG or CNG, comprising a hollow body of thermoplastic material with at least one outlet, which has a surrounding contact area, one boss for each outlet, such boss having at least one aperture to the interior of the hollow body and being connected over the entire space of a complementary part with the contact area, the aperture having a diffuser at a bottom end, sealing the aperture in axial direction and having openings directing primarily only in radial direction, with a static eliminator wall inside the hollow body surrounding the diffuser.

Background Information

In the prior art tanks for storing gases or fluids are known, which are under low or high pressure, like e.g. liquefied petroleum gas (LPG) or liquefied natural gas (LNG) or compressed natural gas (CNG). These tanks are manufactured inter alia of thermoplastic material in a blow moulding, rotation moulding, PET blowing process or injection moulding process. In order to increase the compressive strength, these tanks are covered in a second step with an outer layer of resilient fibres, which are generally embedded in a resin, which bonds the fibres to each other and fixes them to the inner plastic layer.

Regardless of the embodiment, such a tank has to be provided in any case with at least one boss, to which pressure-tightly a coupling piece like a valve, hose or tube end is mounted, in order to fill or empty the tank. The connection between boss and coupling piece can be made through a latch-locked plug or bayonet socket, for high pressure applications however mainly screw plugs with low thread pitches are used.

The inside hollow body, also called liner, can be made of metal, e.g. aluminum, titanium or steel, however as mentioned at the beginning also of plastic e.g. a thermoplastic material. Such thermoplastic materials have the advantage, that they can be moulded easier, have therefore lower manufacturing costs and are adapted in their thermal coefficient of expansion better to the matrix of the fibre-reinforced outer layer, which is usually a resin. A disadvantage is however a lower pressure resistance towards metal liners with comparable wall thickness as well as a lower temperature resistance. Depending on the application, these advantages however stand back behind the advantages mentioned above.

A further disadvantage of plastic liners, which is an important factor for the present invention, is their low electric conductivity and the thereof resulting tendency of static charges when filled with a fluid flowing in under high pressure. The fluid flows out of the outlet of the usually metal filling valve with a high velocity and thus carries away electrons, which are then deposited at the point of impact during the impact on the inner tank wall. A charge separation can furthermore be caused by the fluid jet, which hits the opposite side of the inner wall with a high velocity.

In hollow bodies or liners made of metal or another conducting material, a charge equalization can take place quickly and easily. To further increase the safety, the hollow body/liner as well as the valve can also be grounded. This is not or hardly possible respectively effective for plastic liners, e.g. from thermoplastic materials due to their bad electric conductivity. This results in the static charge of the hollow body/liner, which can discharge in the literal sense in a flash and unpredictably. It could come to an explosion, if there is still remaining oxygen inside the tank or if the filled fluid (mixture) itself is flammable. This problem occurs above all during the filling process of an empty, dry pressure tank, as the discharge of arising static charges can hardly take place and also, when there is still oxygen available, should no inert gas treatment have been made before.

As prior art two kind of solutions have been proposed for this problem, which can be summarized with the keywords elimination and prevention. Both solutions are exemplified in the U.S. Pat. No. 7,656,642 B2 (Ulekleiv et al.)

The solutions for elimination propose, to improve the conductivity of the inner tank wall, for example by a conductive coating of the apart from that not or hardly conducting plastic material. The disadvantage of this solution is however, that the advantage of the easier and low-budget manufacturing process of thermoplastic liners thus is at least partly eliminated again. Moreover, such a coating is wearing off quickly at those areas of the inner tank wall, which are subject to high stress, above all at the point facing the outlet. Also the application of antistatic additives is limited, as these have only an effect for a short time.

The prevention strategy however tries to start with the cause for the static charge, which is to be seen in the high inflow velocity of the fluid out of the valve. For its reduction it is proposed, to add a diffuser at the bottom end of the valve, which seals the aperture in axial direction and has only radially directing openings, so that the inflowing fluid obtains a redirection. Thus it is slowed down on one hand and on the other hand does not impact the facing inner wall as bundled jet, but is split into several partial flows, which are without further treatment first spreading in a horizontal direction and then, influenced by gravity, would in a slight deviation hit nearly tangentially the inner wall. In order to reach a further velocity reduction, a.m. patent proposes however, to surround the diffuser inside the outlet of the liner additionally with a cylindrical collar, which is formed as part of the liner/hollow body. The fluid exhausting from the radial openings of the diffuser therefore hits the collar and is thus redirected once again and strongly slowed down.

A disadvantage of this solution is, that the extreme slow-down of the fluid by the surrounding closed collar leads to a filling up of the space remaining between the diffuser and the collar, so that a strong counter pressure is built up and thus the flow rate is highly reduced. The flow in this space is very turbulent there, thus resulting in a heavy mechanical load of the adjacent parts, diffuser, coupling piece, boss and collar, which accelerates quick aging.

An even more serious problem of the strong counter pressure in the space between diffuser and collar is however, that it leads to the fact, that the inflowing fluid is pressed into the joint between liner and boss, which is located on the upper side of the space between diffuser and collar, by what the tightness of the pressure tank there can be threatened, particularly under high filling pressure and rates.

As the wall thickness and the accuracy requirements of the boss differ considerably from the wall thicknesses and the tolerances of the pressure tank, it is in practice neither reasonable nor economical, to manufacture the boss and tank all of one piece.

Rather, it is common, to provide a hollow body after its completion in a further step with a separately produced and in most cases multi-part boss. For example, patent application US 2011/010/1002 describes a plastic tank with two outlets. Onto these outlets, each from the outside and from the inside, an approximately cylindrical boss is placed, which is widened at one end with a collar-like flange. These two parts are screwed together with a thread and thus pressed together, so that they lie plainly from the inside and from the outside on the area around the outlet of the tank. By corresponding pressure and by additionally inserted sealing rings in the tank or the flange, the required pressure strength is obtained.

Patent publication US 2014/0299610 A1 describes a pressure tank with a two-piece boss, its outer part of a softer, more flexible material providing the connection to the hollow body/liner and to its fibre-reinforced layer. A second part is embedded concentrically in this outer boss, which provides a connection possibility to a valve or other coupling piece in form of an internal thread. It is manufactured from a harder material, in order to withstand the occurring forces. Between the inner part and a screwed valve there is a sealing lip of the boss, which secures together with one or more sealing rings around the valve the tight position of the valve even at high pressure.

This publication teaches to reduce the radial thickness of the sealing lip proportionally to the requested test pressure. A disadvantage is however, that the sealing lip is perhaps under high pressures not able to balance out the pressure-induced deformation of valve, boss and outlet and particularly of the sealing rings, what may result in leakage.

SUMMARY

On this background, the present invention has tackled the task to develop for composite pressure tanks a boss, which prevents effectively static charge, enables nevertheless high filling rates and guarantees absolute tightness also at high pressures.

As a solution, the invention teaches to provide a static eliminator wall around the diffuser, which is formed as part of the boss or of a neckring, which is explained below, or of the coupling piece. Tightness during filling process is then ensured by the fact, that the unavoidable joint between boss and hollow body/liner is advantageously positioned outside the space between diffuser and static eliminator wall, which is stressed by a high dynamic load during the filling process.

In a preferred embodiment such a decrease of the velocity pressure is reached with several turbulence release openings, spread over its circumference. The fluid, which is flowing into the space between the diffuser at the bottom end of the aperture and the static eliminator wall can leave this space through such openings. This unloads the remaining space between the diffuser and the static eliminator wall and thus provides a higher flow rate. The flow turbulence can be influenced furthermore by appropriate positioning of the turbulence release openings relatively to the radial diffuser openings. It hereby makes sense, to provide for each diffuser opening at least one turbulence release opening in the static eliminator wall. These can be aligned approximately with the assigned diffuser openings. In this case a high flow rate is achieved and a minimum turbulence flow in the area of the boss. Ideally, the size of the turbulence release openings is chosen a bit smaller than the jet cross section of the fluid flowing out of the diffuser openings, having taken into consideration the jet widening after leaving the diffuser openings. This effects, that the flow is not completely laminar, what reduces the charge separation by the flow.

An alternative proposal is to align the diffuser openings with the massive wall segments between the turbulence release openings. An alignment of the diffuser openings with the middle of the wall segments is preferred in order to achieve an as equal as possible load on the wall segments, caused by the fluid which hits them with active force. With this relative positioning a strong deceleration is achieved similar to the continuously circumferential collar known as prior art, however with the essential advantage, that the inflowing fluid has a further flow path with the turbulence release openings and that a stationary flow to the greatest possible extent is generated in the space between. Thus, the heavy stress on the material from a highly turbulent flow is eliminated and the occurring static counter pressure is advantageously reduced considerably. Despite deceleration and two times redirection of the inflowing fluid the maximum possible flow rate is hardly reduced compared to a tank without diffuser (and/or static eliminator wall) also in this embodiment. Outside as well as inside the space in between a sprinkler like effect arises with this alignment, in which the fluid, when it hits the wall segments of the static eliminator wall with full force, is dispersed in fine until very fine droplets, which then partially fall downwards directly through the gap between diffuser and wall segments and partially enter finely spread out of the turbulence release openings the outer tank volume. Thus, there is no more bundled fluid jet, which could cause further static charge when it hits the interior space of the hollow body.

When material with a better conductivity compared to the liner material is used for the boss, or a non-conductive material is provided with a conductive coating, this leads to a further advantage of the teaching of the invention. This relates to the fact, that most of the charges, i.e. electrons, which are carried away by the flow in the valve or coupling piece, are already deposited at the static eliminator wall. This is also known from the prior pressure tanks, where however an effective charge backflow is prevented by the execution of the collar as part of the non-conducting hollow body. When the boss is manufactured from conductive material, a charge backflow is possible without problem in the present invention due to the integration of the static eliminator wall in the boss.

An essential idea of the present invention is thus the integration of the static eliminator wall into the boss of the pressure tank, the boss serving in the end the (pressure)-resistant connection of an actual coupling piece for the mounting of fluid containing hoses or tubes with the hollow body including a possible fibre-reinforced covering layer. This prevents the joint between boss and hollow body from being a weak point in the space between diffuser and static eliminator wall. The idea is furthermore, to reach by inserting turbulence release openings a to a large extent stationary, less turbulent flow process in the space in between, what reduces the counter pressure that is built up and therewith the stress on the material of the parts, which are exposed to this pressure and what correspondingly increases the flow rate of the given filling pressure. The fluid is sprinkler like dispersed when it hits the wall segments of the static eliminator wall or at the latest when leaving the turbulence release openings, which act as constriction, and it leaves the area of the space in between as a shower of fine and finest droplets, which have no longer sufficient kinetic energy, in order to effect an appreciable charge disposal when they perhaps hit the inner wall of the hollow body or by friction in the air. The antistatic effect of the static eliminator wall with turbulence release openings according to the present invention is therefore at least equivalent to the one with a continuous collar, avoids however its massive disadvantages.

Further advantageous developments of the present invention, which can be realized alone or in combination, as far as they don't obviously exclude themselves mutually, shall be presented and explained below.

Preferably the number of turbulence release openings is an integer multiple of the number of radial diffuser outlets. Particularly the present invention proposes to provide an equal number of turbulence release openings and diffuser openings. Furthermore, the static eliminator wall has preferably the same symmetries as the diffuser. Particularly preferred, diffuser as well as static eliminator wall including the turbulence release openings have an n-fold rotation symmetry with n 2 and a mirror symmetry. Thus it is ensured, that the loads onto the boss, which are generated by the redirection of the flow and the torques are equalized and the boss is all in all free from loads and torques.

The turbulence release openings can have different forms, for example as round or oval openings in the static eliminator wall. Preferably they are however designed as elongated gaps or grooves, beginning at the bottom edge of the static eliminator wall and extending above an essential part of its vertical dimension, which in tangential direction have a width corresponding approximately to the diameter of the diffuser openings. First of all this is easy to manufacture and secondly results in a flow direction of the inflowing fluid in the area of the boss, which represents a very good balance between turbulence and laminarity and altogether a quasi-stationary flow. For a further flow control, the lateral contour of the static eliminator wall can vary, e.g. an additional waviness can be impressed to a basic circular contour or a polygonal basic form is chosen.

A further possibility to advantageously influence the flow conditions during the filling of the pressure tank is, to impress a suitable topography to the face surface of the diffuser, onto which the inflowing fluid hits before leaving the diffuser openings. This can be designed for example as a convex or conical elevation opposite of the flow direction of the impacting fluid, what leads to an improved pressure release of the boss and higher flow rates.

In order to be able to guarantee a protection against over pressure during the release of fluid out of the pressure tank, for example in case of a line break, a mechanism can be integrated in the diffuser, which closes the apertures at too high flow rates.

A further advantageous embodiment is to design the static eliminator wall as a separate part to be fixed to the coupling piece. This simplifies maintenance respectively exchange of the static eliminator wall as a heavily used and therefore liable to wear component. When using a static eliminator wall without turbulence release openings, which is subject to highest loads when being hit by the fluid, this easy serviceability constitutes a considerable advantage towards prior art designs, in which the adequate collar is an internal, integral part of the hollow body/liner.

Irrespective of whether the static eliminator wall is fixed to the coupling piece or designed as integral part of boss or neckring, different materials can be used for its manufacturing, in order to influence electrostatic or wear properties. Thus, for example also a thermoplastic material can be used besides a metal.

The boss of the pressure tank according to the present invention is in the most general case made of one piece, i.e. a coupling or connection possibility for valves, hoses, tubes or similar is integrated in the boss itself. This avoids advantageously additional contact points respectively joints, which could endanger the tightness of the pressure tank. Based on the different requirements regarding the material properties of the boss in the contact area with the hollow body, where it has to be sufficiently flexible and elastic in order to conform to the elongation of the hollow body under pressure load and thermal influence and in the area of the coupling to a fluid containing valve, hose or tube, where it needs a sufficient stability and hardness to avoid quick fatigue with frequent coupling and uncoupling, the present invention proposes however an at least two-piece embodiment of the boss. In this case a second part, the so-called neckring, from hard material, preferably metal is concentrically embedded into an outer connection part made of softer, tougher material, particularly a material which is similar to the thermoplastic material of the hollow body, with which it can be connected by liquefying. Such neckring has an internal thread or another coupling possibility for the connection to a valve or another coupling piece. Hereby the neckring is pressed or moulded into a complementary opening of the actual boss. Alternatively, the boss is formed by casting or injection process around the neckring.

The neckring, particularly its contact area to the actual boss, preferably has no circular symmetry, but only an n-fold rotation or particularly preferred a mirror symmetry with a mirror plane, which contains the axial direction. The shape of the contact area can for example be polygonal, a star or a waved line. Thus the contact area is enlarged and a better transmission of the torque is possible from neckring to boss. Additionally the present invention proposes to insert grooves and/or connection holes spread circumferentially in the neckring respectively the surrounding collars or flanges, into which the liquid thermoplastic material can flow during the manufacturing process. After cooling down, thus a particularly stable connection, suitable for torque transfers, is reached then. This is important, as the torques which may occur during possible frequent changes, i.e. screwing in and out of a coupling piece, could deteriorate the bond between neckring and actual boss, which could lead to leakage up to failure of the boss over the years.

The same applies also for the transmission of the a.m. torque from the boss to the hollow body. Therefore also the contact area between boss and hollow body is formed as a non-circular torque coupling. Like the contact area from neckring to boss, the shape can also be polygonal, a star or a waved line here. Alternatively a thermoplastic hollow body can be blown around the boss, which guarantees a very tight connection and force transmission, particularly when there are vertical holes in the outer area of the boss, into which the still liquid material of the hollow body can flow and solidify there. The disadvantage in this case is, that the boss has already to be available when the hollow body is manufactured and can also not be changed without damaging it.

Therefore the present invention preferably proposes, to design the contact areas for the boss or the bosses in the area of the outlet(s) of the hollow body in a way that they are accessible from outside, so that the boss can be inserted and welded and/or impressed after the hollow body is ready and solidified. In particular the axial cross section of the outlet should be strictly increasing outwards, in such a way, that the axial projection of the farther outside located cross sections comprise the ones on the farther interior side. If the boss part is made of a thermoplastic material similar to the one of the hollow body material, then the connection can preferably be made by liquefying the surface of the contact areas and pressing them together.

In the prior art, the diffuser belongs to a coupling piece, i.e. the valve for connecting a hose or tube and in the most general case the present invention comprises such an embodiment, too. Preferably the present invention proposes however, to integrate the diffuser, like also the static eliminator wall, into the boss itself. This is against the background, that a coupling piece, which is usually screwed to an internal thread of the boss respectively the neckring, does not always have the same angle position relatively to the static eliminator wall, but at least slightly varies this position with every screw process. Thus the relative position of the diffuser openings to the turbulence release openings is also not always the same, which may have a negative effect on the flow process of the inflowing fluid. This variation of the relative position is advantageously eliminated by integration of the diffuser into the boss.

The radially directing diffuser openings are preferably round, oval or polygonal, particularly rectangular. A further advantage of this embodiment is that standard coupling pieces typically are not equipped with a diffuser, but have a simple, axially directing inlet opening at the bottom end. With the integration of the diffuser into the boss itself, the present invention thus can use the advantages of a deceleration of the fluid which flows in under high pressure through diffuser and antistatic eliminator wall, despite of using standard coupling pieces.

The neckring, which is embedded in the actual boss, preferably has a centering groove at the top of its outlet. It ensures an always constant positioning of neckring and boss during the manufacturing process of the boss, what is important for the a.m. relative alignment of turbulence release openings and diffuser openings. It also simplifies later on the quick connection and centering of coupling pieces, particularly, when this shall be done in an automated manner, for instance by an assembling robot.

In an even more preferred embodiment, the neckring comprises a collar, which is directing in axial direction downwards and is surrounded on its outside by the material of the boss. On one hand the contact area to the actual boss is thus enlarged farther. On the other hand, the material of the boss, which is radially directing inwards from the collar, forms a sealing lip, whose radial thickness has an essential influence on the tightness of the pressure tank.

Through the finite vertical dimension of the boss, the aperture is extending a bit into the interior of the hollow body when the boss is mounted. The pressure inside the tank is now affecting this toroidal protrusion inside and outside, whereupon the inner side depending on a design without or with integral diffuser is formed by the coupling piece or the bottom part of the boss. Thus the material of the boss and particularly the sealing lip is compressed. Furthermore, fluid or gas is pressed into the gap between a sealing ring of a coupling piece and the sealing lip by the pressure in the tank and sealing ring as well as sealing lip are deformed in such an extent, until the forces between the tensions in the sealing ring, the sealing lip and the pressure inside the tank are balanced out.

In case the chosen dimension of the radial thickness of the sealing lip is not sufficient, this leads to leakage at the connection between actual boss and neckring or boss and coupling piece. The latter can be avoided by using a sealing ring between coupling piece and sealing lip. The hardness of this sealing ring should increase with the test pressure of the tank, and therefore also with the intended maximum filling pressure.

The present invention therefore proposes a larger dimension of the radial thickness of the sealing lip with the intended test pressure of the tank of this embodiment. In practice it is recommended to increase the thickness of the sealing lip proportionally to the test pressure. Tests have provided evidence, that a change according to the relations $$D\ \text{max (mm)}=0.01P\ \text{(bar)}+3.0$$

$$D\ \text{min (mm)}=0.019D\ \text{max (mm)}+2.95$$

guarantees optimum tightness. P is the test pressure, Dmin the lower and Dmax the upper limit of the preferred radial sealing lip thickness D. The use of a sealing ring between sealing lip and coupling piece with a shore hardness of at least 90 is presumed.

An alternative way for the sealing between boss and valve, which in prior art is applied especially for pressure tanks with a hollow body made of steel, is the use of valves with conically tapered external thread. The metal sealing which is herewith achieved, in standard practice still supported by a viscous sealant, makes the use of a sealing ring unnecessary. In an advantageous embodiment of the present invention, the connection of such a tapered valve is provided by suitable design of the neckring. Particularly the design of the boss without the diffuser is addressed, as tapered valves in most widely distributed design are already equipped with a diffuser, but without static eliminator wall. In order to be able to adjust also in this embodiment the relative position of diffuser openings and turbulence release openings, it is proposed to provide at boss and valve suitable marks, which indicate the position of the openings.

In order to withstand very high-test pressures of several hundreds up to more than one thousand bar, the hollow body of the pressure tank of the present invention must have an outer fibre-reinforced covering layer. This is all the more necessary, as the thermoplastic materials which are suggested for the hollow body, can withstand only a few bar on their own, at least approximately ten bar, with typical wall thicknesses in the range of millimeters. The fibres used in this layer can be synthetic fibres, like glass, carbon, aramide, Dyneema or other synthetic fibres, or natural fibres. Different kind of fibres can also be processed in a combination, in order to optimize costs, for example in case of a requested stiffness. The matrix, into which these fibres are embedded, consists either of thermal or UV-curable (synthetic) resins like for example epoxy resin, or of plastic, for example polyethylene, which can be applied in liquefied form to the fibre-wrapped liner and are then allowed to solidify. Particularly preferred the hollow body surface is submitted to a treatment before the winding with fibres and the application of a matrix in which they are embedded, what increases the roughness and thus achieves a better adhesion between composite layer and liner/hollow body.

BRIEF DESCRIPTION OF THE DRAWINGS

Further specified details and characteristics of the invention shall be explained below with illustrated embodiments. These shall however not limit the invention, but only explain it. In schematic representation are shown.

DETAILED DESCRIPTION OF THE EMBODIMENTS

Figure 1A:
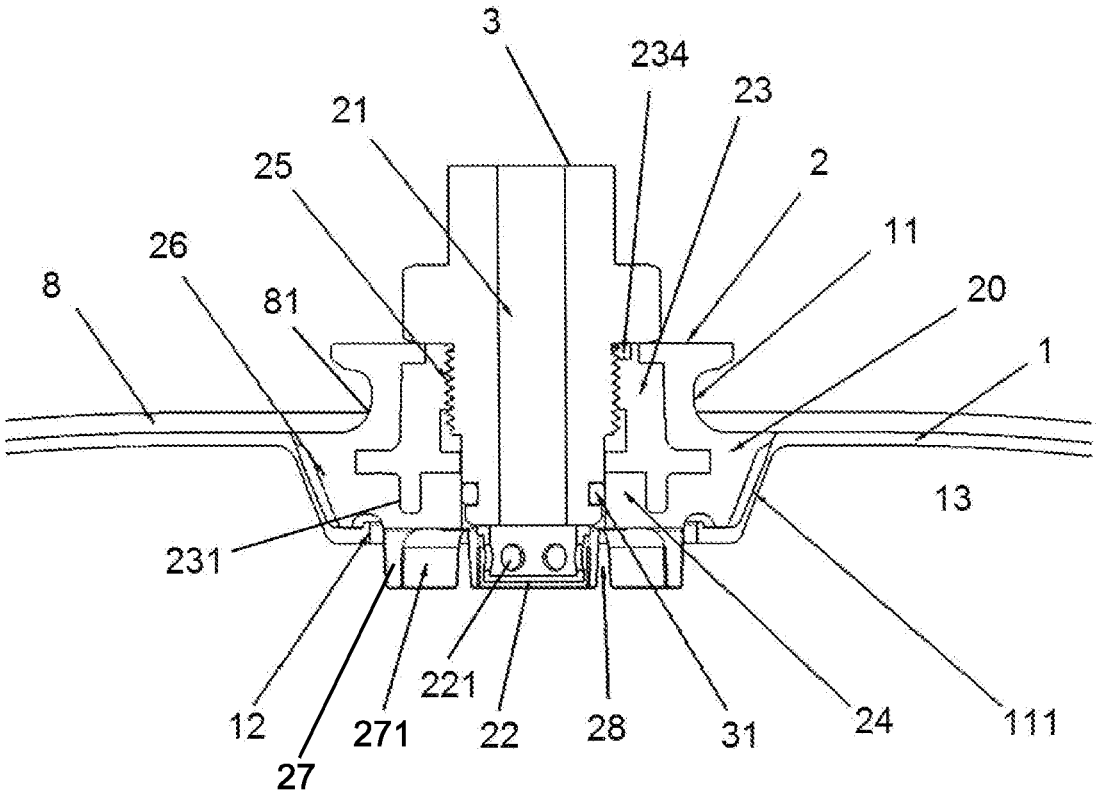
FIG. 1*a* is a partial cross-sectional view of the pressure tank according to an embodiment of the present invention showing a static eliminator wall with turbulence release openings at a boss and an integral diffuser of a coupling piece.

FIG. 1*a* illustrates a cross-section through an outlet of a pressure tank according to the present invention with mounted boss. Boss 2 is connected tightly into outlet 11, whereupon the complementary contact areas 26 and 111 form a torque coupling for the constant and effective transmission of the torque from boss 2 onto hollow body 1. Another torque coupling is formed by the contact areas between boss part 20 of boss 2 and the fibre-reinforced layer 8, which covers hollow body 1 and partly boss part 20. The boss 2 has two parts and consists of an outer boss part 20 and its integral neckring 23, which has an internal thread 25, for screwing the coupling piece 3 into boss 2. During the manufacturing process, particularly in an automated manner by an assembling robot, the handling and positioning of coupling piece 3 is facilitated by the centering groove 234 at the upper end of the internal thread 25. At the bottom end of aperture 21 the diffuser 22 is an integral part of the coupling piece 3.

Diffuser 22 serves for the deceleration and redirection of a fluid flowing in under high pressure, by closing aperture 21 in axial direction and comprises only openings 221 in radial direction. The fluid, which flows in radially after having passed through the diffuser openings 221, hits the static eliminator wall 27 around the diffuser 22 with a lower velocity, compared to a theoretical flow rate without diffuser, such static eliminator wall is formed as cylinder collar which is interrupted by turbulence release openings 28, here designed as elongated grooves. Static eliminator wall 27 is an overhang of the outer boss part 20 in axial direction and is therefore an integral part of boss part 20. Diffuser 2 has a mirror- and rotation-symmetric design with a 6-fold rotation symmetry in this embodiment, so that the coupling piece remains force- and torque-free during the filling process. The same applies also to static eliminator wall 27.

This secures an essential improvement of the present invention, particularly that the joint 12 between hollow body 1 and boss 2 lies outside the space between diffuser 22 and static eliminator wall 27. Thus it is advantageously avoided, that the fluid flowing in under high pressure is pressed into the joint due to the high static counter pressure, which is built up in the said space in between, perhaps together with the dynamical pressure of the fluid, which hits under high pressure the boundary surface of the space in between, thus permanently compromising the tightness of the pressure tank during the filling process or in the worst case during plastic deformation.

This is promoted by the fact that only a small counter pressure is built up in the said space, as the turbulence release openings 28 create an additional outflow path. When flowing through the openings 28 the fluid is thus dispersed into a "fog" of fine droplets, which minimizes the risk of a static charge of areas which are in a greater distance from outlet 11.

The tightness of the described pressure tank of the present invention is advantageously guaranteed farther, during the filling process as well as in a pressure-filled state, by a dimensioning of the radial thickness of sealing lip 24, which is located between a neckring collar 231, which is extending downwards from the neckring 23 in radial direction and sealing ring 31 of the coupling piece 3, increasing proportionally with the intended test pressure, i.e. maximum pressure of the tank.

Figure 1B:
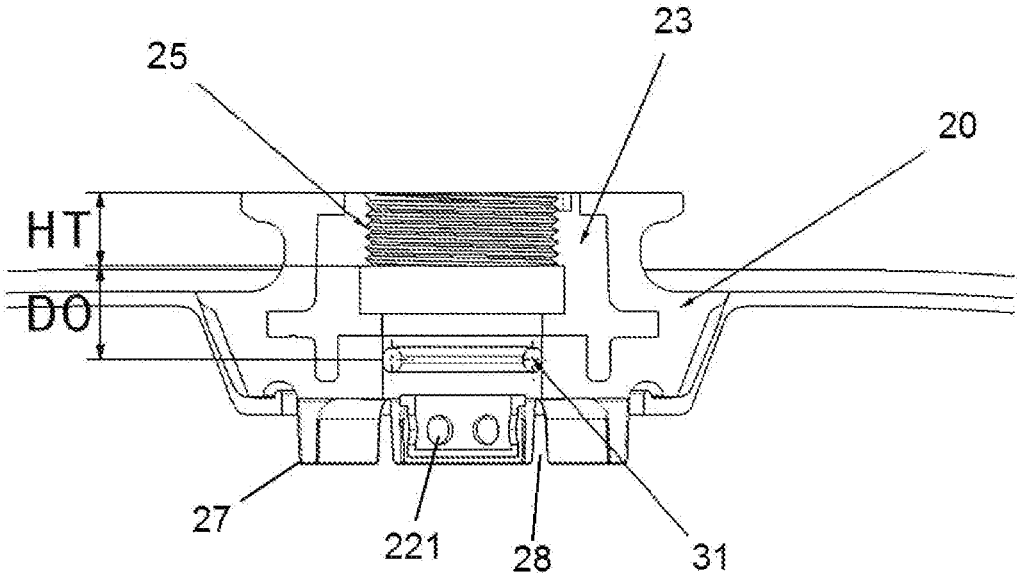
FIG. 1*b* is a section of the bottom part of the boss shown in FIG. 1*a*.

FIG. 1*b* illustrates an enlarged section of the bottom half of boss 2 respectively of the bottom end of aperture 21. The difference of height HT of the internal thread 25 and distance DO between bottom edge of internal thread 25 and O-ring 31 is chosen according to the relation $HT-DO \leq 0.5$ TP, TP standing for the thread pitch of the internal thread 25.

Figure 2:
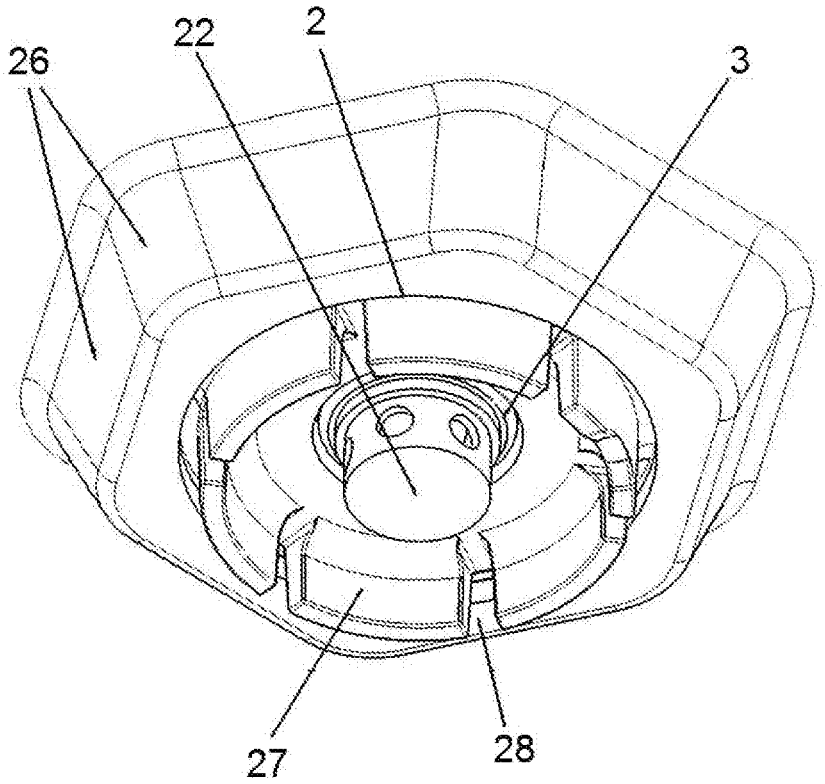
FIG. 2 is a bottom perspective view from an angle of the boss shown in FIG. 1*a*.

FIG. 2 illustrates a perspective view from an angle below onto the boss of FIG. 1. It shows the hexagonally shaped contact area 26, which forms a torque coupling for the transmission of torque from boss 2 onto the hollow body of the pressure tank, with the complementary contact area of the outlet of the hollow body, into which boss 2 is mounted and welded or bonded. Coupling piece 3, which comprises at its bottom end the diffuser 22, which forms a flow obstacle in axial direction, is screwed to the internal thread of the not visible neckring 23. Coupling piece 3 is screwed to such an extent, that the diffuser openings 221, which are extending in radial direction, align approximately with turbulence release openings 28 in the static eliminator wall 27. Thus, a high flow rate is achieved during the filling process, however at the same time also a still good antistatic effect by the appropriate narrow dimensioning of the turbulence release openings 28 in the width. Such effect is however optimized, when the diffuser openings 221 do not align with the turbulence release openings 28, but face the continuous ones of the static eliminator wall 27, so that fluid, which flows out of the openings 221, hits these and is farther slowed down. In this case nearly all loads, which are carried away from the coupling piece 3 or the diffuser 22, are deposited in the static eliminator wall 27, from where they are directed away by droplets to the coupling piece 3 respectively diffuser 22, as static eliminator wall 27 is part of the boss 2, which can be designed relatively more conductive, and not of the non-conducting hollow body 1.

Figure 3A:
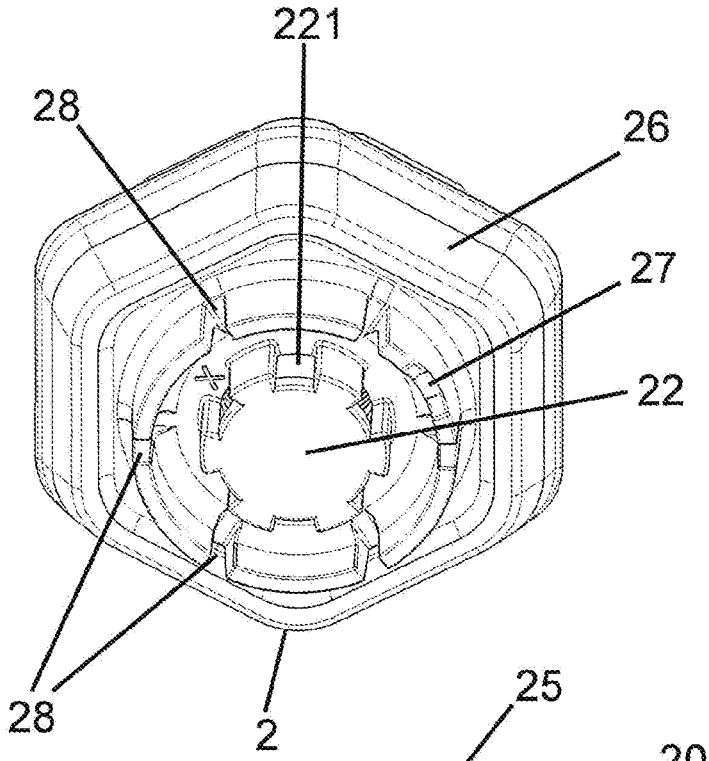
FIG. 3*a* is a bottom perspective view from an angle of the pressure tank according to another embodiment of the present invention.
Figure 3B:
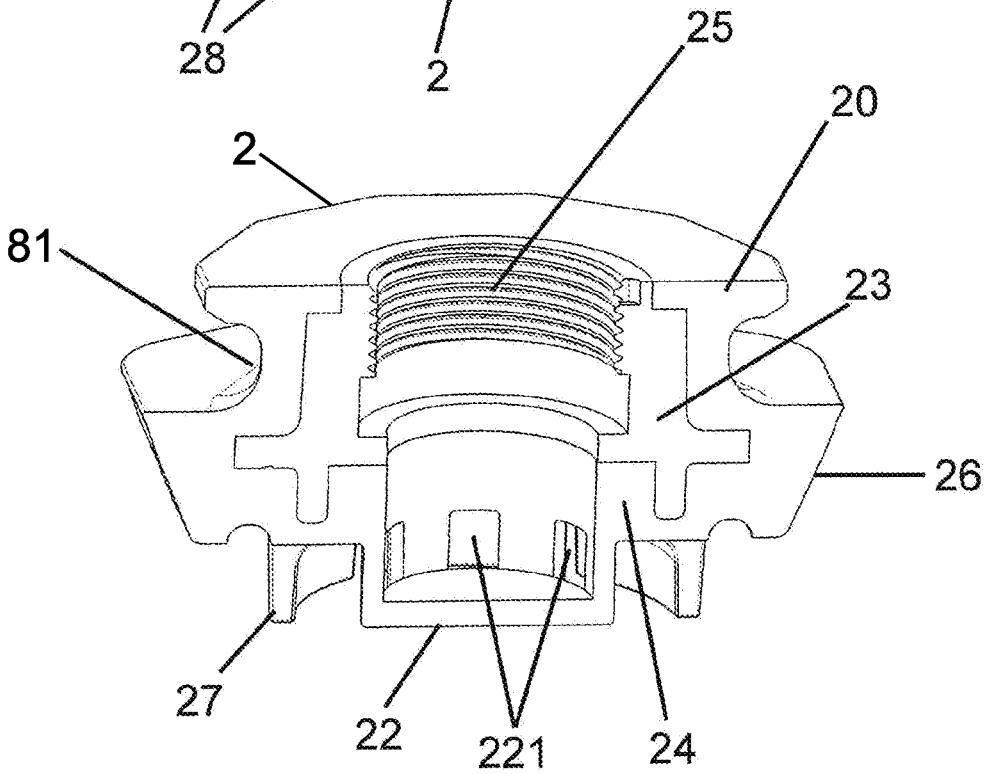
FIG. 3*b* is a partial cross-sectional view of the pressure tank in FIG. 3*a* showing the boss with integral diffuser.

In FIGS. 3*a* and 3*b* a further preferred embodiment of the boss of the pressure tank of the present invention is illustrated. The upper section figure (FIG. 3*a*) shows a perspective view from an angle below, stating that the diffuser openings 221 are aligned relatively to the static eliminator wall 27 with the turbulence release openings 28 in such a way, that the fluid jet, which flows out of the openings 221, hits exactly centrically the massive static eliminator wall segments 27. Like the embodiment illustrated in the FIGS. 1-2, the diffuser 22 has also a mirror- and 6-numbered rotation symmetry.

The lower section figure (FIG. 3*b*) illustrates a cut-away section of the boss 2. It can be seen that this is also formed from two parts, the outer boss part 20 and neckring 23. In turn, neckring 23 comprises an internal thread 25 for mounting a hose, tube, valve or other coupling piece. The essential difference to the previous embodiment is, that diffuser 22, as clearly visible in this section figure, forms an integral part of boss 2, particularly boss part 20. Thus, it is avoided that the relative alignments of the diffuser openings 221 with the static eliminator wall 27 and the turbulence release openings 28, may differ with each screw process.

Figure 4:
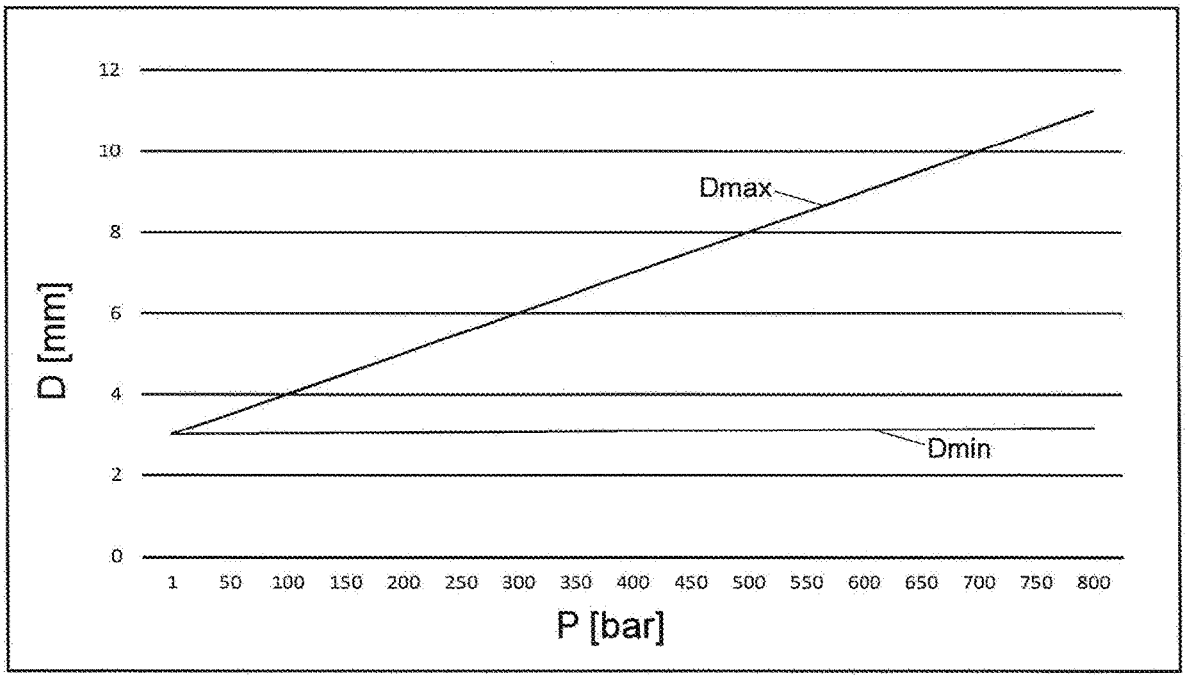
FIG. 4 is a graph illustrating the relation between test pressure and sealing lip thickness in a radial direction.

FIG. 4 shows in a graph the relation the present invention recommends between the radial thickness D of sealing lip 24 and the requested test pressure. The sealing lip thickness is represented on the y-axis, the pressure on the x-axis. The course is strictly increasing in a straight line with a proportionality constant (slope) of 0.01 mm/bar in case of the recommended maximum thickness Dmax and 0.019 mm/bar in case of the minimum recommended thickness Dmin. The axis intercepts at 100 bar are 3.03 mm respectively 4.0 mm with minimum respectively maximum recommended thickness. The radial thickness D for the specified test pressure P should therefore lie between Dmin and Dmax, in order to guarantee optimum tightness.

Figure 5:
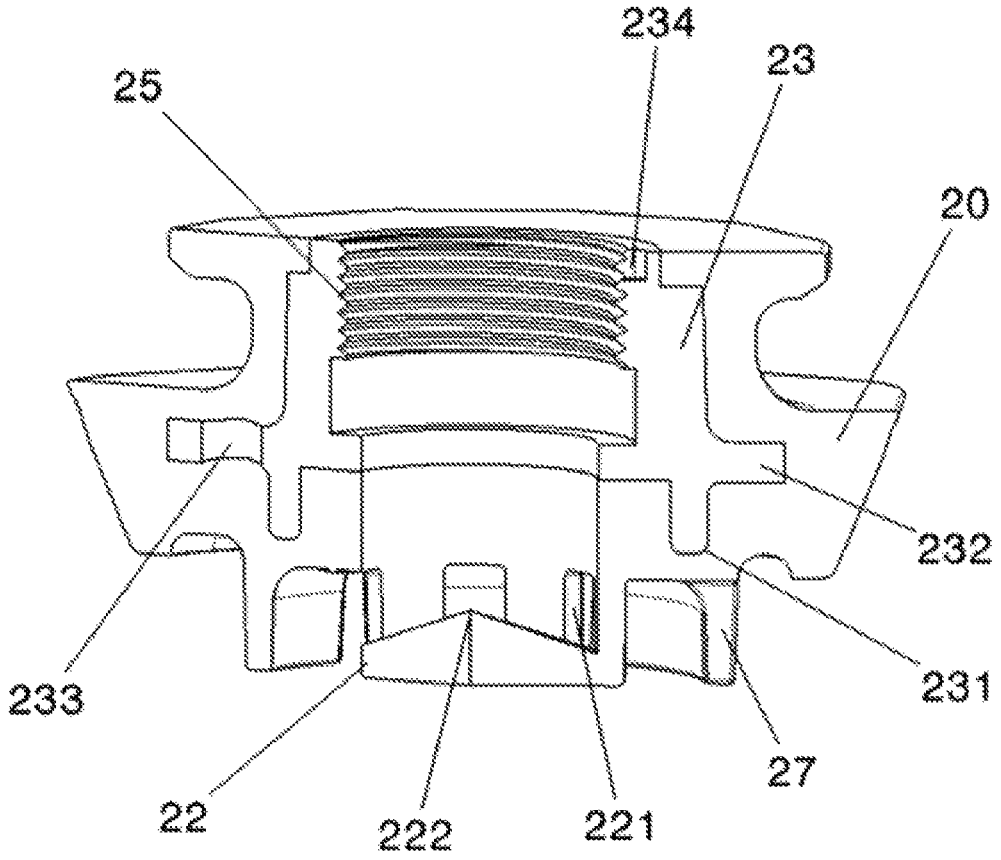
FIG. 5 is a partial cross-sectional view of a pressure tank according to a further embodiment of the present invention showing a boss with a contoured diffuser face surface.

FIG. 5 illustrates a further advantageous embodiment of the boss 2 of the pressure tank of the present invention, which has on the inner face surface 222 of the diffuser a truncated cone shaped elevation facing the flow direction of the inflowing fluid for the modification of the flow conditions. The lateral neckring flange 232 stabilizes the neckring 23 for axial loads. Neckring holes 233 are inserted in it, into which the liquid thermoplastic material of the boss can flow during the manufacturing process.

Figure 6:
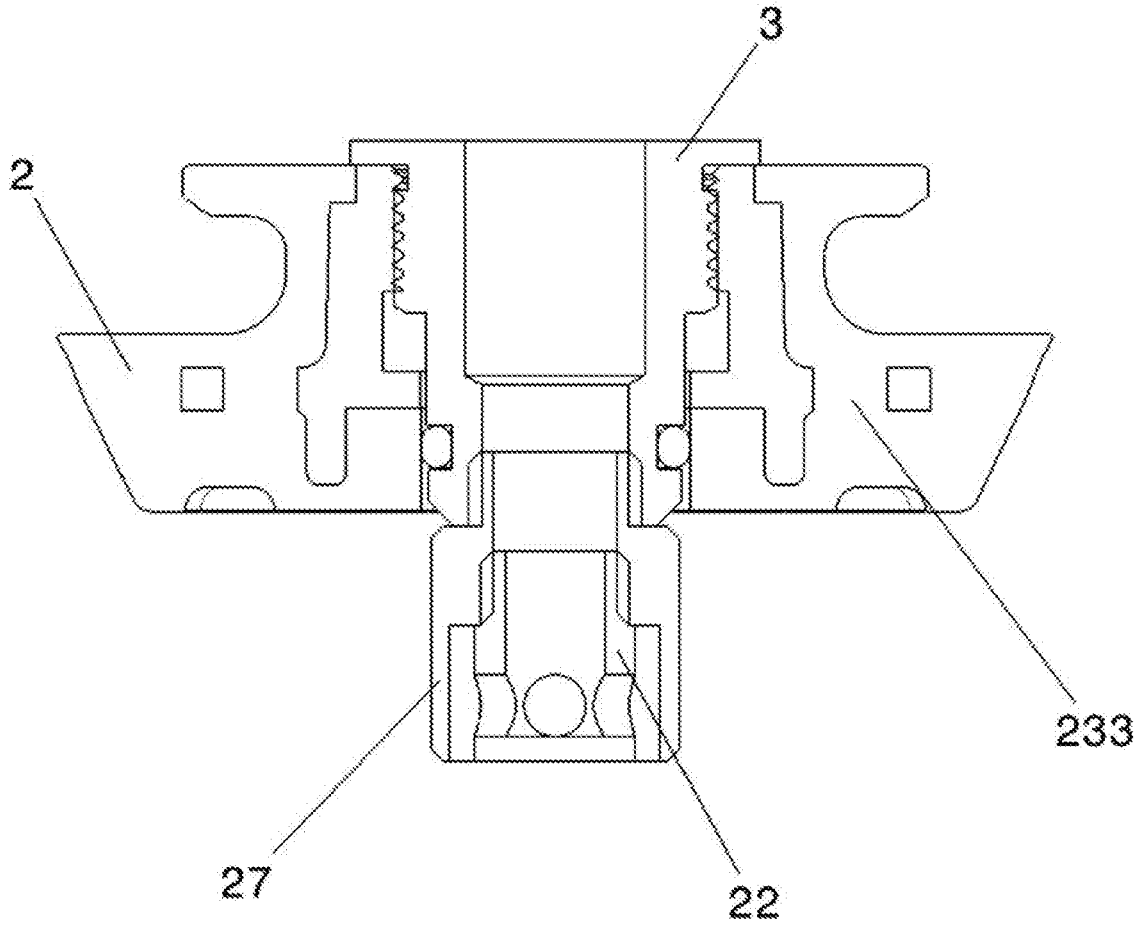
FIG. 6 is a partial cross-sectional view of the pressure tank according to a further embodiment of the present invention showing a boss and coupling piece with static eliminator wall belonging to the latter and a diffuser.

FIG. 6 illustrates an embodiment, in which the diffuser 22 as well as the static eliminator wall 27 form a part of the coupling piece 3. This offers the special advantage, that the static eliminator wall 27 as highly stressed component can easily be made accessible for service or exchange measures, by dismounting the coupling piece 3.

Figure 7:
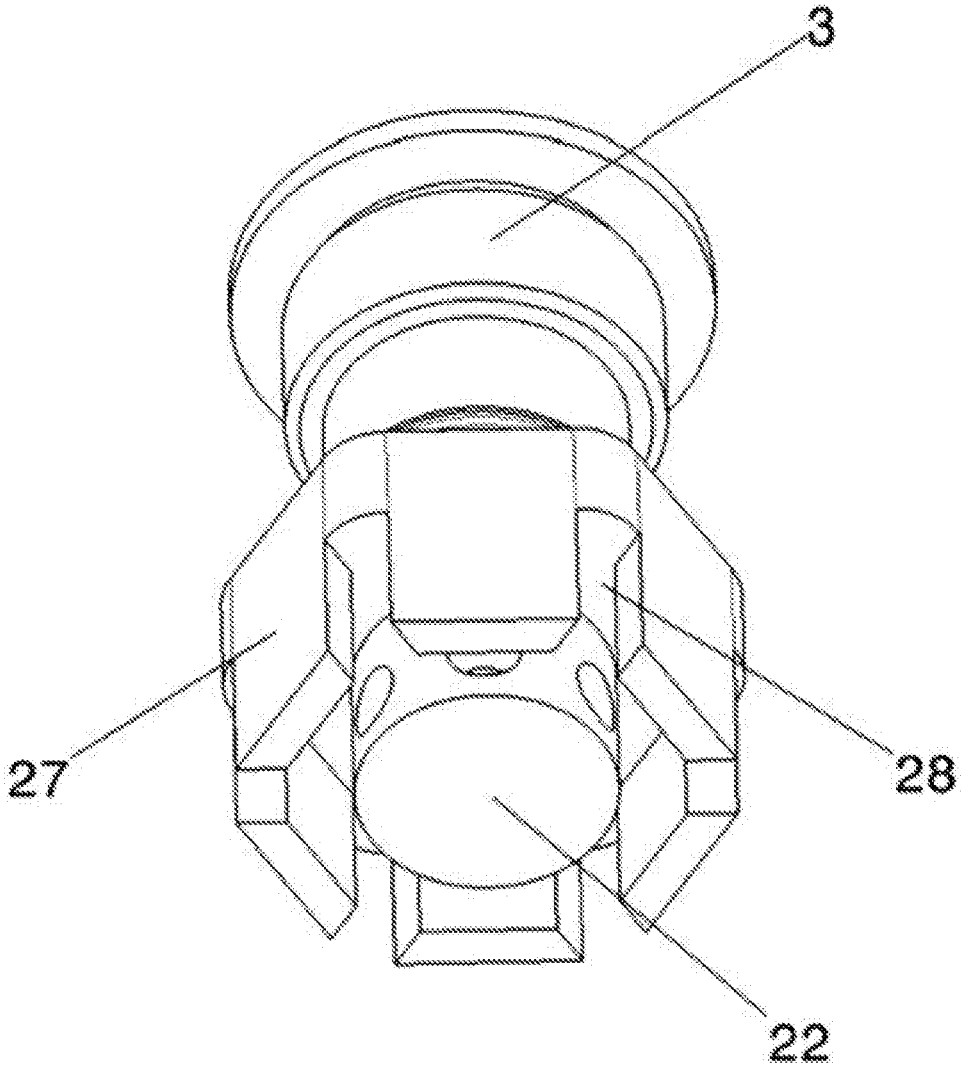
FIG. 7 is a bottom perspective view from an angle of a pressure tank according to a further embodiment of the present invention showing a coupling piece with static eliminator wall and a diffuser.

FIG. 7 illustrates an embodiment of the static eliminator wall 27 and the diffuser 22, in which the turbulence release openings 28 of the static eliminator wall taper radially and show a polygonal contour. Such shaping of the turbulence release openings and appropriate contours on the inner surface of the static eliminator wall, which faces the diffuser 22, represent a possibility, to explicitly direct the fluid flow and also to influence the material wear of the static eliminator wall 27 itself.

Figure 8A:
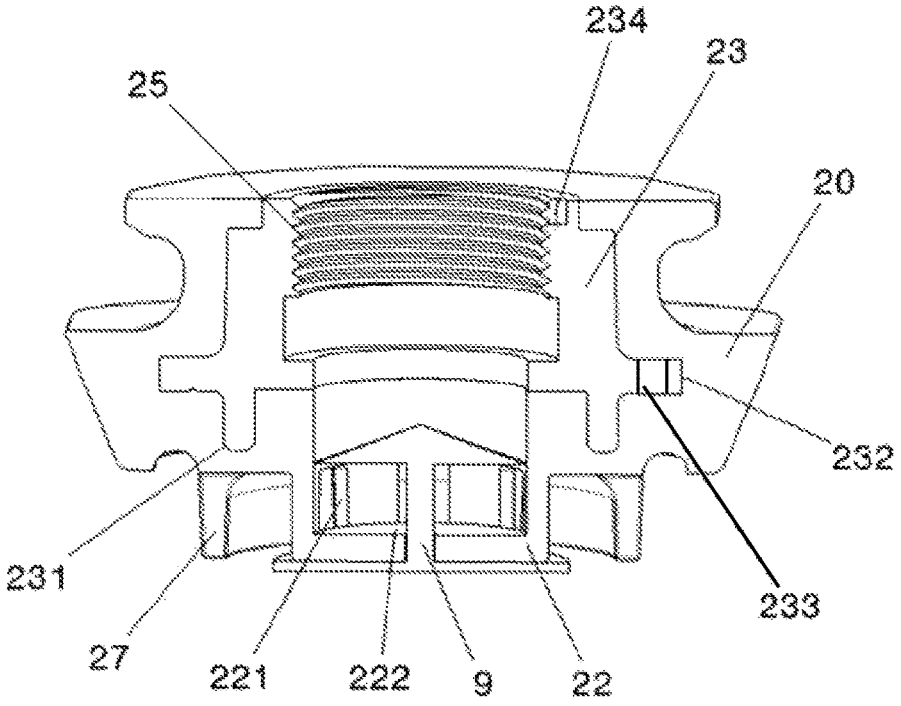
FIG. 8*a* is a partial cross-sectional view of the pressure tank according to a further embodiment of the present invention showing a boss with integral pressure relief device in the diffuser (closed position).
Figure 8B:
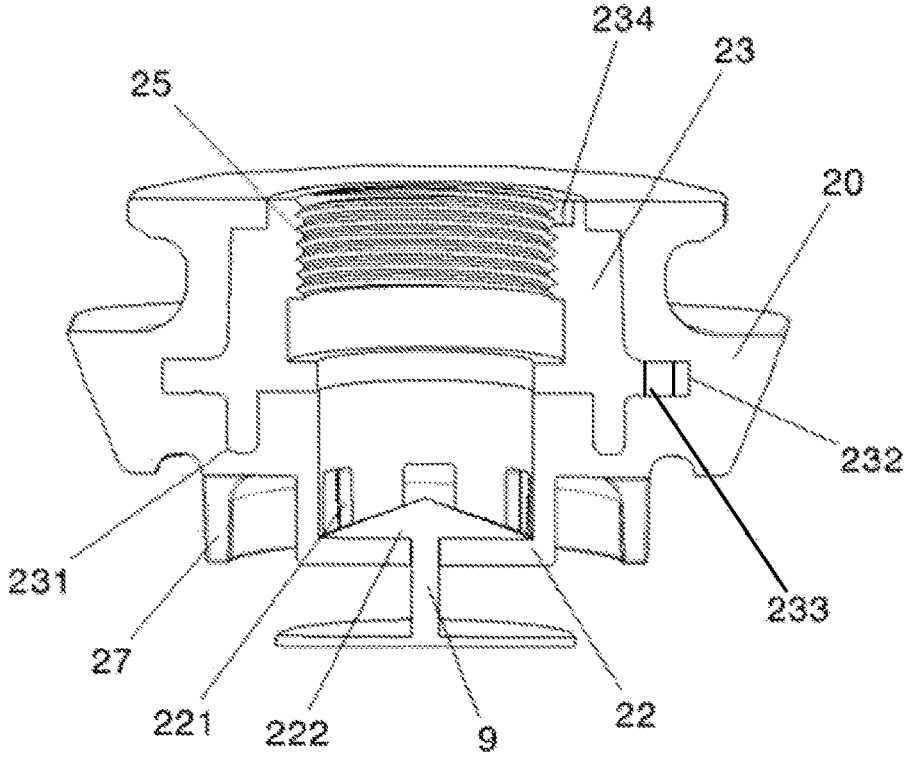
FIG. 8*b* is a view similar to FIG. 8*a* but showing a pressure relief device in the open position.

FIG. 8*a* illustrates an embodiment of the diffuser 22 with integral pressure relief device 9, which is shown here in closed position. A complementary illustration of the pressure relief device 9 in an open position is shown in FIG. 8*b*. In case of a sudden pressure loss on the outlet side and therefore flow increase during the fluid unloading, for example when a line bursts, the pressure relief device is drawn along and closes the outlet above the diffuser openings 221.

LIST OF REFERENCE NUMERALS

1 Hollow body
11 Outlet in hollow body 1
111 Contact area
12 Joint between hollow body and boss
13 Interior of the hollow body
2 Boss
20 Boss part
21 Aperture
22 Diffuser
221 Diffuser opening
222 Inner face surface of the diffuser with elevation
23 Neckring
231 Neckring collar
232 Neckring flange
233 Neckring holes
234 Centering groove
24 Sealing lip
25 Internal thread
26 Contact area
27 Static eliminator wall
271 Inner static eliminator wall surface
28 Turbulence release opening
3 Coupling piece
31 Sealing ring
8 Fibre-reinforced layer
81 Torque coupling
9 Pressure relief device
P Test pressure
D Sealing lip thickness, radial
Dmin Minimum recommended sealing lip thickness
Dmax Maximum recommended sealing lip thickness
TP Thread pitch
HT Thread height
DO Sealing ring distance to the bottom thread margin

The invention claimed is:

1. A pressure tank for storage of high and low pressure fluids/gases, including LPG, LNG or CNG, the pressure tank comprising:

a hollow body of thermoplastic material with at least one outlet having a surrounding contact area;

a boss connected to the outlet of the hollow body, the boss having at least one aperture extending into to the interior of the hollow body and being connected over its entire surface with a complementary contact area to the contact area of the outlet of the hollow body, the aperture having a diffuser disposed at a bottom end thereof and being one of part of the boss, part of a neckring, and part of a coupling piece, the diffuser sealing the aperture in an axial direction and having diffuser openings pointing primarily in a radial direction; and a static eliminator wall disposed inside the hollow body and surrounding the diffusor, the static eliminator wall being one of an integral part of the boss, a part of the neckring, and a part of the coupling piece.

2. The pressure tank according to claim 1, wherein the static eliminator wall is formed of a plurality of circumferentially disposed spaced-apart wall segments and has a plurality of turbulence release openings formed between the spaced-apart wall segments.

3. The pressure tank according to claim 2, wherein the turbulence release openings are elongated openings extending upwardly from a bottom edge of the static eliminator wall; and wherein the diffuser openings are aligned with either the elongated openings or aligned with respective centers of the wall segments of the static eliminator wall.

4. The pressure tank according to claim 1, wherein the static eliminator wall faces the diffuser and has one of a round contour, a waved line contour, and a polygonal contour.

5. The pressure tank according to claim 1, wherein:

the diffuser openings are one of round-, oval- and polygonal-shaped openings; or the diffuser has an interior face surface in the form of one of a plane, a convex elevation, and a conical elevation; or the diffuser has a mechanism for closing the aperture of the boss during a critical flow rate of the fluid.

6. The pressure tank according to claim 1, wherein the aperture of the boss has an internal thread into which the coupling piece is screwed, the coupling piece having for sealing purposes one of at least one sealing ring and a tapered external thread.

7. The pressure tank according to claim 6, wherein the boss comprises the neckring which lies concentrically in an outer connection part of the boss and provides at least a part of the aperture and the internal thread.

8. The pressure tank according to claim 7, wherein the neckring:

has one of an n-fold rotation symmetry and no symmetry, and/or has a mirror symmetry with a mirror plane, which comprises the axial direction, and/or has a surrounding collar extending in a radial direction and provided with holes, and/or has a centering groove at the top of the aperture of the boss, and/or is manufactured of metal, and/or has connecting holes and grooves.

9. The pressure tank according to claim 8, wherein the connection part of the boss:

is made of a thermoplastic material; and comprises the contact area, by which it is connected over its entire surface with the complementary contact area of the outlet in the hollow body, particularly through injecting, bonding or welding by superficial liquefaction of the thermoplastic materials of the contact areas of the connection part of the boss and the outlet in the hollow body.

10. The pressure tank according to claim 9, wherein the neckring has at a bottom side thereof a neckring collar directing downwards and surrounding the aperture of the boss, the neckring collar being embedded outside in the material of the connection part of the boss so that a material of the boss between an internal side of the neckring collar and the aperture of the boss forms a sealing lip.

11. The pressure tank according to claim 10, wherein at least one sealing ring lies between the coupling piece and the sealing lip.

12. The pressure tank according to claim 11, wherein a radial thickness of the sealing lip is selected proportionally to a test pressure (P) of the pressure tank.

13. The pressure tank according to claim 12, wherein the radial thickness of the sealing lip is selected between a minimum thickness (Dmin) and a maximum thickness (Dmax), these thicknesses Dmin and Dmax being linked with the test pressure (P) by the relations:

$$D\ \text{max (mm)}=0.01P\ \text{(bar)}+3.0\ \text{and}$$

$$D\ \text{min (mm)}=0.019D\ \text{max (mm)}+2.95.$$

14. The pressure tank according to claim 6, wherein the difference between the height (HT) of the internal thread and the axial distance between a bottom end of the internal thread and the center of the sealing ring follows the relation $$HT\ \text{(mm)}-DO\ \text{(mm)}\leq 0.5\ \text{TP}$$

and

HT (mm)=$n_T$ TP (mm) is still valid, (TP) being a pitch of the internal thread in millimeter per winding and $n_T$ indicating the number of windings of the internal thread.

15. The pressure tank according to claim 8, wherein the neckring has a polygonal cross section.

16. The pressure tank according to claim 1, further comprising a first torque coupling formed by the contact area of the hollow body and the complementary contact area of the boss, wherein the first torque coupling has no circular symmetry regarding rotation around the axial direction of the aperture of the boss.

17. The pressure tank according to claim 16, wherein the first torque coupling has a polygonal shape.

18. The pressure tank according to claim 1, further comprising a covering layer disposed on a surface of the hollow body, the covering layer being reinforced by one or more synthetic and/or natural fibres selected from glass fibres, carbon fibres, aramid fibres, and dyneema fibres, the fibres being embedded in a matrix formed of one of thermal and UV-curable resins, and the surface of the hollow body on which the covering layer is disposed being provided with a treatment that increases a connection between the covering layer and the hollow body.

19. The pressure tank according to claim 18, further comprising a second torque coupling integrally formed into the covering layer in an area of the outlet of the hollow body, the second torque coupling having an n-fold rotation symmetry for transferring a torque applied to the boss to the covering layer.

20. The pressure tank according to claim 19, wherein the second torque coupling has a polygonal shape.

* * * * *